United States Patent [19]

McRobert et al.

[11] Patent Number: 4,981,117

[45] Date of Patent: Jan. 1, 1991

[54] AUTOMATIC CLEARANCE ADJUSTER

[75] Inventors: Stewart C. McRobert, Sutton Coldfield; Peter J. Gill, Wolverhampton, both of England

[73] Assignee: GKN Technology Limited, West Midlands, England

[21] Appl. No.: 476,390

[22] PCT Filed: Dec. 14, 1988

[86] PCT No.: PCT/GB88/01108

§ 371 Date: May 29, 1990

§ 102(e) Date: May 29, 1990

[87] PCT Pub. No.: WO89/05898

PCT Pub. Date: Jun. 29, 1989

[30] Foreign Application Priority Data

Dec. 19, 1987 [GB] United Kingdom ..... 8729660

[51] Int. Cl.[5] ..... F01L 1/22

[52] U.S. Cl. ..... 123/90.43; 123/90.54

[58] Field of Search ..... 123/90.43, 90.45, 90.52, 123/90.53, 90.54, 90.55, 90.58

[56] References Cited

U.S. PATENT DOCUMENTS

| | | | |
|---|---|---|---|
| 2,308,858 | 1/1943 | Burkhardt | 123/90.49 |
| 3,024,775 | 3/1962 | Wuest | 123/90.45 |
| 3,270,726 | 9/1966 | Cotton | 123/90.52 |
| 3,376,860 | 4/1968 | Johnson et al. | 123/90.43 |
| 4,548,168 | 10/1985 | Gill | 123/90.54 |
| 4,706,620 | 11/1987 | Gill | 123/90.54 |
| 4,867,112 | 9/1989 | Ishii | 123/90.54 |

FOREIGN PATENT DOCUMENTS

| | | | |
|---|---|---|---|
| 672148 | 2/1939 | Fed. Rep. of Germany | 123/90.54 |
| 510864 | 8/1939 | United Kingdom | 123/90.54 |

*Primary Examiner*—Charles J. Myhre
*Assistant Examiner*—Weilun Lo
*Attorney, Agent, or Firm*—Marshall, O'Toole, Gerstein, Murray & Bicknell

[57] ABSTRACT

A mechanical automatic clearance adjuster (10) of the type comprising a screw (24) of generally buttress thread form running within an internally threaded housing (22) on running flanks (38,40) under the action of axially directed spring means (26) has the screw (24) provided with grooved locking flanks (42) incapable of establishing contiguous engagement with the co-operating locking flanks (44) of the housing. The adjuster (10) is described for use in a valve train application in an internal combustion engine.

4 Claims, 2 Drawing Sheets

AUTOMATIC CLEARANCE ADJUSTER

This invention relates to a mechanical automatic clearance adjuster as may be used as a clearance adjuster for a valve operating mechanism in an internal combustion engine or compressor or the like. A mechanical automatic clearance adjuster comprising an internally threaded female member, a male member within said female member having an external thread form generally complimentary to the internal thread form of the female member, the thread form exhibiting a relatively high friction in one direction of axial loading of the screw threads compared with a relatively low friction in the opposite direction of axial loading, spring means acting on the male member to bias it in the said opposite direction of axial loading and thus to urge the male member in a direction to advance axially of the female member with the thread form being configured to provide co-operating running flanks and locking flanks whereby the male member will rotate and advance axially of the female member under the axial thrust of the spring means on the said running flanks is referred to throughout this specification as "a mechanical automatic adjuster of the kind specified".

Mechanical automatic adjusters of the kind specified used as valve clearance adjusters are disclosed in GB No. A-2033472 and EP No. A-0032284. In one such adjuster described and illustrated in the above patent specifications, an externally threaded screw member runs within a complimentarily internally threaded bush which bush comprises an integral part of one end of a rocker arm; the screw member being disposed between a spring, at one end, and a cam or cam-operated push rod at the other end. In another embodiment, the screw member comprises an integral end part of a valve stem which part runs within a complimentarily internally threaded bush in a bucket type tappet; such arrangement being particularly applicable to an overhead cam valve operating mechanism.

In GB No. A-2160945 there is described and illustrated a self-contained mechanical automatic adjuster of the kind specified comprising a pre-assembly of a housing having an internal buttress thread form, a screw member having a co-operating external buttress thread form and a compression spring within the housing acting to bias the screw member to rotate and advance axially out of the housing.

In all of the above mentioned disclosures, the buttress thread form exhibits a relatively high friction in that direction of axial loading of the male member relative to the female member which is opposed to the direction of the spring loaded axial bias. Conversely, the thread form exhibits a relatively low friction in that direction of axial loading in which the spring means biases the male member whereby the male member may rotate and advance axially of the female member upon the running flanks of the co-operating threads under the axial spring bias. The aforesaid relatively high friction is exhibited between the locking flanks of the co-operating threads which are designed in a manner intended to prevent any substantial degree of rotation of the male member relative to the female member in that said direction of axial loading of the male member which is opposed to the direction of the spring loaded axial bias.

In GB No. A-2160945 it is disclosed that, despite the wedging/locking engagement which is obtainable between the locking flanks of the male and female members in the high friction direction of axial loading, a condition can sometimes arise in use when, for a short period of time, friction conditions on the co-operating locking flanks are very low as a result of the oil film and that axial loading produces "back off" rotation of the male member relative to the female member. The existence of an oil film between the locking flanks can lead to an excessive degree of such back-off rotation and it is an object of the present invention to provide an improved mechanical automatic adjuster of the kind specified wherein the co-operating thread forms of the male and female members are configured to mitigate against an undesirably low friction condition developing between the co-operating locking flanks as a result of an oil film existing between them.

In accordance with the invention there is provided a mechanical automatic clearance adjuster comprising an internally threaded female member, a male member within said female member having an external thread form configured to run within the thread form of the female member, the thread forms exhibiting a relatively high friction in one direction of axial loading of the screw threads compared with a relatively low friction in the opposite direction of axial loading, spring means acting on the male member to bias it in the said opposite direction of axial loading and thus to urge the male member in a direction to advance axially of the female member with the thread form being configured to provide co-operating running flanks and locking flanks whereby the male member will rotate and advance axially of the female member when the axial thrust of the spring means urges said running flanks together and wherein the surfaces of the locking flanks as seen in axial cross section are so configured as to be incapable of contiguous mating engagement with one another.

It is preferred that the locking flank of the female member comprises a continuous surface as seen in axial cross section and the locking flank of the male member comprises a discontinuous surface as seen in axial cross section. Preferably the said discontinuous surface of the locking flank of the male member is limited to a width less than the width of the engaging locking flank of the female member and comprises a plurality of helically extending lands and grooves.

Other features of the invention will become apparent from the following description given herein solely by way of example with reference to the accompanying drawings wherein.

Figure 1:
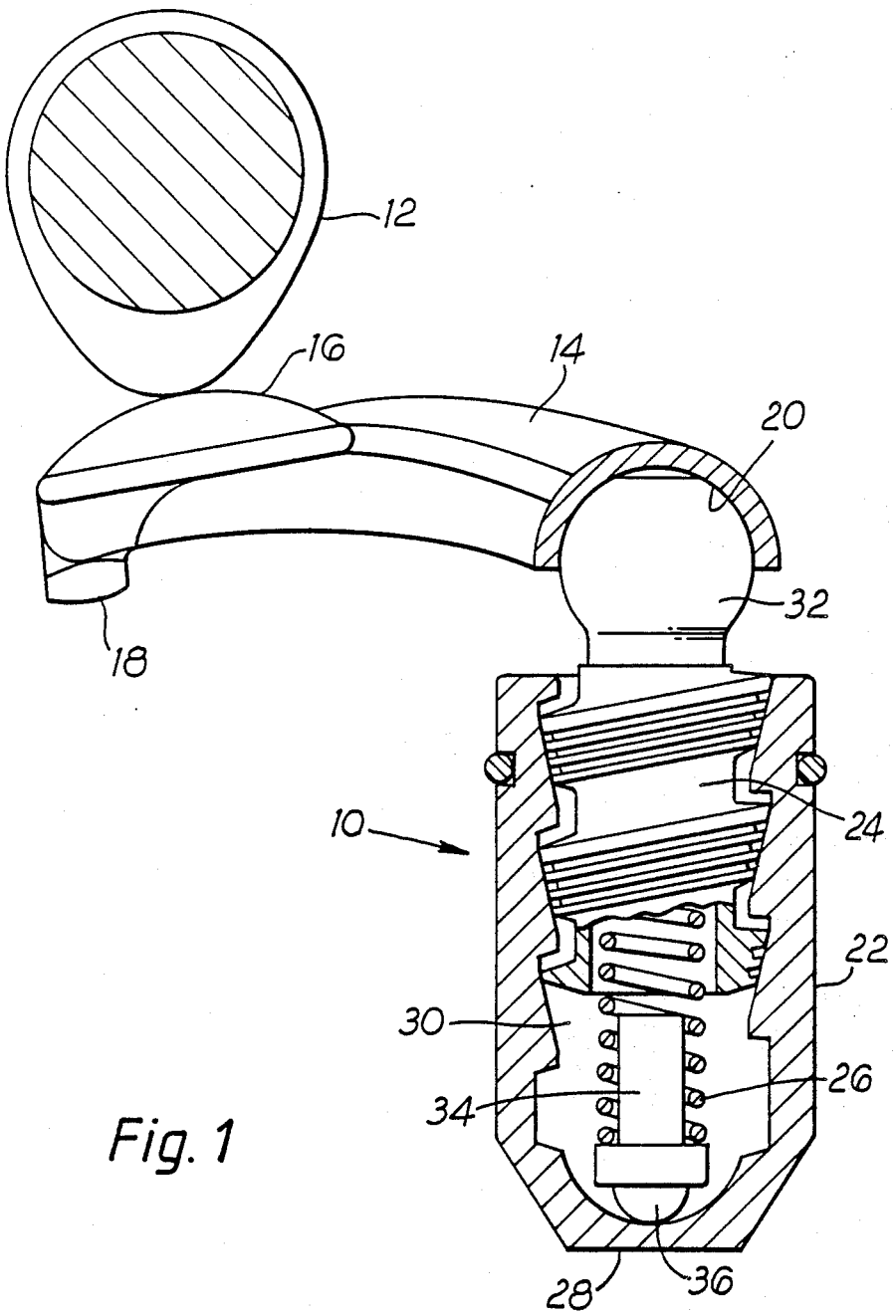
FIG. 1 is a diagrammatic view of a clearance adjuster in accordance with the invention incorporated in an internal combustion engine valve train mechanism.

In FIG. 1 of the drawings there is shown a mechanical automatic clearance adjuster 10 constructed in accordance with the invention incorporated in an internal combustion engine valve train mechanism comprising a cam 12, an end-pivot type of rocker arm 14 and the said adjuster 10. In accordance with known practice, the rocker arm 14 has an upper surface curved slipper portion 16 upon which the cam acts, a lower surface abutment portion 18 at one end of the rocker arm for acting on a valve stem (not shown) and a lower surface hemispherical recess 20 at the other end of the rocker arm which comprises a fulcrum point for the arm.

The adjuster 10 comprises a self contained assembly of housing 22, screw member 24 and compression spring 26 of the same general type described in GB No. A-2160945. As will be seen from FIG. 1, the housing 22 has a lower closed end 28 and a central bore 30 having a buttress thread formed on the walls thereof. The screw member 24 is formed with an external buttress thread form, as described in more detail below, and an upper domed end 32 for co-operating engagement by the hemispherical recess 20 of the rocker arm. The compression spring 26 acts between a lower surface of the screw member 24 and a spacer 34 which itself engages the lower closed end 28 of the housing through a low friction bearing element such as the ball end 36 illustrated.

The self-contained adjuster described so far is thus suitable to replace a conventional hydraulic tappet in an end-pivot rocker arm application. However, although not illustrated herein, it should be appreciated that the screw member and the housing may be of a similar arrangement to that described in GB No. A-2033472 wherein, in one embodiment, the housing comprises an integral part of one end of a rocker arm and, in another embodiment, the screw member comprises an integral end part of a valve stem.

The buttress thread forms of the screw member and the housing are so configured as to exhibit a relatively high friction in one direction of axial loading of the screw threads compared with a relatively low friction in the opposite direction of axial loading whereby the screw member may rotate and advance axially of the housing under the axial thrust of the compression spring. That is to say, as illustrated, the compression spring urges the screw member to run freely upwardly of the housing at all times.

Figure 2:
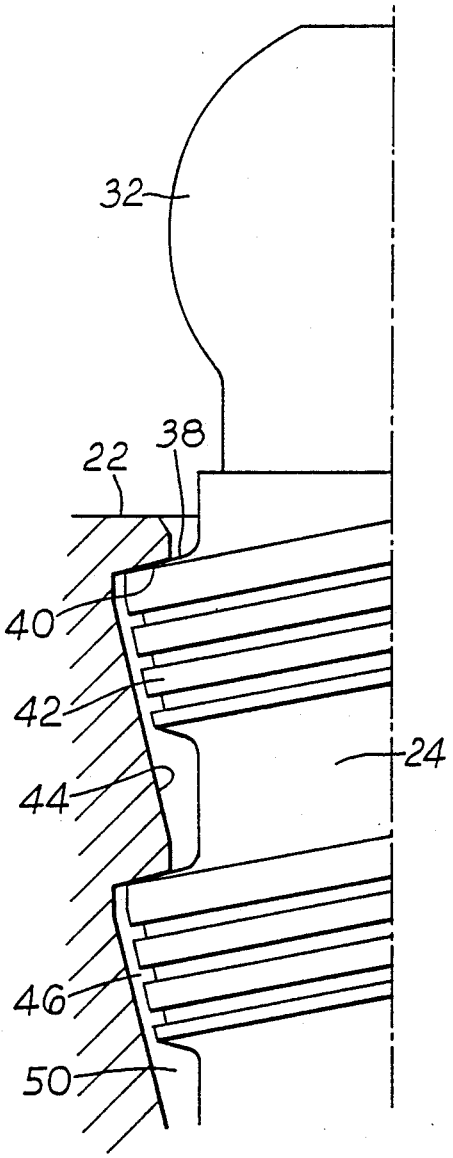
FIGS. 2 and 3 are schematic representations of the positional relationship of the thread forms of the screw member and the housing during a sequence of valve opening and valve closing loads applied by the cam.

Before describing the thread form configuration in detail, the mode of operation of the adjuster will be described with reference to FIGS. 2 and 3. When the cam 12 is in a rotational position displaced through 180 degrees from that shown in FIG. 1, there is no valve operating load on the screw member 24 and the compression spring 26 therefore ensures that the surfaces of the running flanks 38 and 40 of the buttress thread forms respectively of the screw member 24 and the housing 22 are in contact as shown in FIG. 2. Between the respective locking flank surfaces 42 and 44 of the screw member and the housing there is therefore a clearance 46 in an axial direction which is a predetermined proportion of the required clearance in the valve train mechanism.

Figure 3:
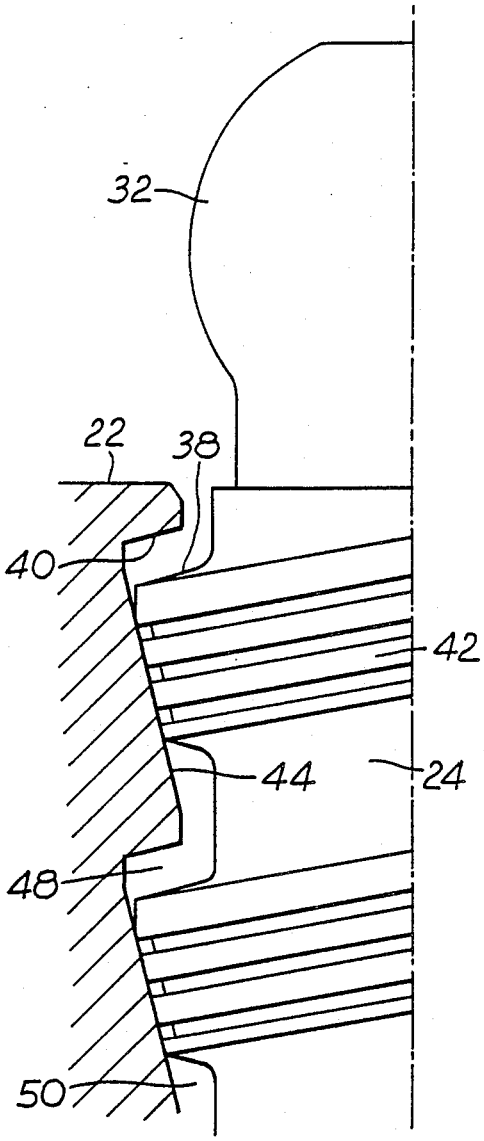

Upon rotation of the cam 12 to the position shown in FIG. 1, it applies a load via the rocker 14 arm to the screw member 24 which moves the screw member parallel to its axis (i.e. vertically downwardly as illustrated) giving a clearance 48 between the running flanks 38 and 40 as shown in FIG. 3. The locking flank surfaces 42 and 44 of the threads come into contact where they are substantially wedged due to the high friction between these faces resultant upon the particular configuration of the buttress thread form. Rotational movement of the screw member 24 relative to the housing 22 is substantially prevented by this wedging action of the buttress thread form and, consequently, valve opening forces can be transmitted from the cam via the rocker arm to the valve stem.

Thus the screw member 24 is always spring loaded by the compression spring 26 in a direction to bring the running flanks 38 and 40 of the screw threads into contact with one another. The spring is able to move the screw member to take up clearance in the valve train mechanism as described above because of the high helix angle of the screw threads and because the running flanks of the threads offer a relatively low frictional resistance.

However there is always the controlled axial gap between the co-operating buttress screw threads and the magnitude of this gap is governed entirely by the tolerances to which the co-operating threads are manufactured. Thus this axial gap always ensures that the valve is fully closed when the cam is on its low radius profile i.e. as shown in FIGS. 1 and 3 and when cam rotation begins to press the screw member downwardly in its housing from the position shown in FIG. 2, the screw member has to move through the axial gap before the rocker arm can begin to open the valve.

When the screw member 24 has moved through the axial gap in this manner, the locking flanks 42 and 44 of the co-operating screw threads are in contact with one another and in spite of the high helix angle there can be no substantial degree of relative motion between the co-operating screw threads as the lift of the cam is transmitted directly to the rocker arm to open the valve.

However, the mechanism should be capable of providing an increased clearance, i.e. by back-off, if the clearance of the mechanism should reduce below a minimum requirement. When the cam applies valve opening forces and the locking flanks 42 and 44 of the screw member and the housing are approaching the contact position shown in FIG. 3 then for a very short time the friction conditions on the locking flanks are very low as a result of continuous oil film lubrication and so, during this short time on every valve opening movement, the consequent compressive axial force produces a small back-off rotation of the screw member 24 relative to the housing 22 in a direction opposite to that normally induced by the compression spring 26. The aforesaid oil film thickness can support the maximum load applied to the adjuster and the resulting low friction can lead to excessive rotation of the screw member relative to the housing which in turn creates excessive clearance. Thus a progressive back-off rotation can lead to a progressive collapse situation when the take-up capability of the adjuster is insufficient to overcome the excessive back-off per valve opening cycle.

Thus in accordance with the invention the locking flank surfaces 42 and 44 of the co-operating threads of the screw member and housing are so configured to be incapable of establishing contiguous mating engagement with one another.

Theoretical analysis shows that the time taken to disperse a film of oil from between approaching surfaces is proportional to the fourth power of the width of the approaching surface and such approaching surface can be equated to the width of the locking flank 42 in the adjuster of the invention. If the locking flank width is sufficiently low to ensure efficient oil film removal then it is possible that excessive wear may take place on the locking flank surfaces of either or both the screw member and the housing. Thus, in a preferred embodiment of the invention, the locking flank 42 of the screw member 24 is helically grooved as shown in the drawings thereby effectively reducing the width of the screw member locking flank 42 i.e. the locking flank width becomes equivalent to the surface width of each land between each pair of adjacent grooves. By providing several such lands, e.g. four per locking flank as illustrated, the wear rate in the adjuster is reduced.

The reduction of locking flank contact area between the screw 24 and the housing 26 enables the said lands in the locking position illustrated, to effectively break through the oil film lubrication which is present in use and to establish the desired high friction condition leading to locking and prevention of an undesirable degree of back off rotation.

Thus a mechanical automatic clearance adjuster having co-operating thread forms between the male and female members in accordance with the invention provides enhancement of the locking flank performance by increasing the contact pressure between the flanks to the benefit of higher frictional torque and increasing the contact radius to the benefit of reduced helix angle. A further benefit accruing from a thread form in accordance with the invention is that an oil reservoir is created in the annular undercut space 50 below the grooved locking flank 42 within which space 50 the locking flanks 42 and 44 are incapable of establishing mating engagement with one another thereby enhancing the flow of lubricating oil to the running flanks 38 and 40. Said space 50 also creates a helical pressure relief path which ventilates and so prevents entrapment of oil in the lower part of blind ended housings. Furthermore, the reduced width of the locking flank arising from the provision of the undercut portion, makes the clearance in the adjuster less sensitive to manufacturing errors in the thread flank angles.

We claim:

1. A mechanical automatic clearance adjuster comprising an internally threaded female member (22), a male member (24) within said female member having an external thread form configured to run within the thread form of the female member, the thread forms exhibiting a relatively high friction in one direction of axial loading of the screw threads compared with a relatively low friction in the opposite direction of axial loading, spring means (26) acting on the male member to bias it in said opposite direction of axial loading and thus to urge the male member in a direction to advance axially of the female member, with the thread form being formed by co-operating running flanks (38, 40) and locking flanks (42, 44) on each of said male member and female member whereby the male member will rotate and advance axially of the female member when the axial thrust of the spring means urges said running flanks together characterised in that the width of one of the locking flanks (42 or 44) on one of the male and female member is less than the width of the other of the locking flanks (44 or 42 respectively) on the other of the male and female member providing a helical reservoir (50) extending between the male and female members.

2. A mechanical automatic clearance adjuster as claimed in claim 1 further characterised in that the width of the locking flank (42) of the male member is less than the width of the locking flank (44) of the female member.

3. A mechanical automatic clearance adjuster as claimed in claim 2 further characterised in that the locking flank (44) of the female member comprises a continuous helical surface and the locking flank (42) of the male member comprises a discontinuous helical surface.

4. A mechanical automatic clearance adjuster as claimed in claim 3 further characterised in that said discontinuous helical surface of the locking flank (42) of the male member comprises a plurality of helically extending lands and grooves.

* * * * *